US009404282B2

(12) United States Patent
Andrews et al.

(10) Patent No.: US 9,404,282 B2
(45) Date of Patent: Aug. 2, 2016

(54) CANOPY LEG HOLD DOWN PLATE

(71) Applicant: Amy Lynne Andrews, Westminster, MD (US)

(72) Inventors: Daniel Patrick Andrews, Westminster, MD (US); Amy Lynne Andrews, Westminster, MD (US)

( * ) Notice: Subject to any disclaimer, the term of this patent is extended or adjusted under 35 U.S.C. 154(b) by 126 days.

(21) Appl. No.: 14/272,542

(22) Filed: May 8, 2014

(65) Prior Publication Data

US 2015/0322690 A1 Nov. 12, 2015

(51) Int. Cl.
*E04H 15/62* (2006.01)

(52) U.S. Cl.
CPC ..... *E04H 15/62* (2013.01)

(58) Field of Classification Search
CPC . E04H 15/62; E04H 12/2246; E04H 12/2238; A45B 2023/0012
USPC ..... 135/118, 120.1, 114, 116
See application file for complete search history.

(56) References Cited

U.S. PATENT DOCUMENTS 5,007,811 A * 4/1991 Hopkins ..... A45B 3/00 135/16
6,155,524 A * 12/2000 Legler ..... B25H 3/006 248/221.11
6,240,940 B1 * 6/2001 Carter ..... E04H 15/50 135/127
6,981,680 B1 * 1/2006 Gordon ..... E04H 12/2238 135/118
7,077,372 B2 * 7/2006 Moran ..... A61B 19/54 24/573.11
7,213,869 B1 * 5/2007 McClellan ..... E04H 12/2238 248/346.01
8,312,888 B2 * 11/2012 Rees, Jr. ..... E04H 6/025 135/117
8,424,549 B1 * 4/2013 Goldsmith ..... E04H 15/60 135/116
8,789,549 B1 * 7/2014 Barnes ..... E04H 15/62 135/114
8,851,095 B2 * 10/2014 LeAnna ..... A45B 3/00 135/120.1
2005/0199774 A1 * 9/2005 Reese ..... A45B 23/00 248/529
2010/0229905 A1 * 9/2010 Lin ..... E04H 15/48 135/96
2011/0180679 A1 * 7/2011 Ma ..... E04H 12/223 248/346.01
2012/0306232 A1 * 12/2012 Shumaker ..... E04H 15/06 296/136.07

* cited by examiner

*Primary Examiner* — Sarah McPartlin

(57) ABSTRACT

A plastic, preferably recycled plastic, canopy leg anchor plate is used with a portable collapsible canopy unit. It encloses a canopy frame leg and covers the canopy leg's welded attached footplate, and, by ground pegging through the plate and/or placing weight on the plate, provides wind stabilization for the canopy unit. The plate can be molded into various decorative shapes for attractiveness, uniqueness and occupation recognition.

6 Claims, 9 Drawing Sheets

CANOPY LEG HOLD DOWN PLATE

BACKGROUND OF THE INVENTION

This invention relates to a method to ground secure and wind stabilize portable collapsible canopy units. More specifically, this invention relates to a canopy leg hold down plate.

Portable collapsible canopy units such as the ones disclosed in U.S. Pat. Nos. 6,240,940 and 5,244,001, provide outdoor sun protection and inclement weather shelter for people and their belongings at picnics, fairs, campgrounds, markets and other gatherings. Windy conditions require canopy units be anchored to the existing pavement or ground for general safety, and to reduce legal liability in case a canopy unit becomes airborne. Canopy unit manufacturers furnish metal pegs which are intended to be driven into the ground through one or two holes within each canopy frame leg welded attached footplate, and tie-down cords for additional ground anchorage. Other methods for anchoring canopy units include plastic coated concrete discs with an open ended slot to allow them to straddle the canopy frame leg and rest on top of the canopy frame leg welded attached footplate; leg weight cases which can be filled with a variety of weight material (U.S. Pat. No. 8,714,174) steel plates (U.S. Pat. No. 6,981,680) which can be staked to the ground or asphalt; anchor framework weights (U.S. Pat. No. 5,737,883) and sand/material filled fabric bag anchor leg weights. These various weights are heavy and difficult to transport. There are water/material filled bucket leg weights (U.S. Pat. No. 8,439,058) also available for anchoring canopy units, but this system require the canopy support legs be elevated to the top of the buckets, which is unsightly, raises the canopy unit's height and center of gravity. Also, there is a canopy anchor pad system (U.S. Pat. No. 8,312,888). This system requires bolting or hook strapping steel plates with attached pads to the canopy frame legs and applying secondary weights on top of the plates and pads. This system's placement and displacement is more time intensive than the present invention, and requires a safety flap to cover the bolt attachment which the present invention does not.

Therefore, the principle objective of the present invention is to provide a canopy unit anchoring device that effectively anchors the canopy unit.

Another objective of the present invention is to provide a canopy unit anchoring device that facilitates placement and displacement time of the canopy unit anchor device.

Yet another objective of the present invention is to provide a canopy unit anchoring device that facilitates decorative occupation recognition styling of the canopy unit anchor device.

Yet another objective of the present invention is to provide a canopy unit anchoring device that is a recyclable plastic material or a partially recyclable plastic material canopy unit anchor device.

Yet another objective of the present invention is to provide a canopy unit anchoring device that increases safety of the canopy unit anchor device.

Yet another objective of the present invention is to provide a canopy unit anchoring device that increases safety at outdoor events.

Yet another objective of the present invention is to provide a canopy unit anchoring device that decreases legal liability for canopy unit owners at outdoor events.

Yet another objective of the present invention is to provide a canopy unit anchoring device that is a cost effective canopy unit anchor device.

Yet another objective of the present invention is to provide a canopy unit anchoring device that facilitates transporting of the canopy unit anchor device.

Yet another objective of the present invention is to provide a canopy unit anchoring device that facilitates storage of the canopy unit anchor device when not in use.

Lastly, another objective of the present invention is to provide a canopy unit anchoring device that offers a combination of weighting and ground pegging of the canopy unit anchor device.

BRIEF DESCRIPTION OF THE INVENTION

The canopy leg hold down plate device a pressure molded plastic planar plate which pivotally completely encloses a portion of each canopy support leg and covers the majority of the top of each leg's welded attached footplate by use of a portion of the planar plate and either a portion of the locking block swing gate or a portion of the locking block slide gate. Secondary weight may be placed on the top patterned area and optional grounding pegs may be driven through the plate's bored holes, thereby, either individually or in combination, anchor the canopy unit to any surface. The plate may be molded into various decorative, unique and occupation recognition shapes, such as: a human foot, shoe, animal paw, clawed bird foot, clawed reptilian foot, flower or tree silhouette.

DESCRIPTION OF THE INVENTION

Figure 1:
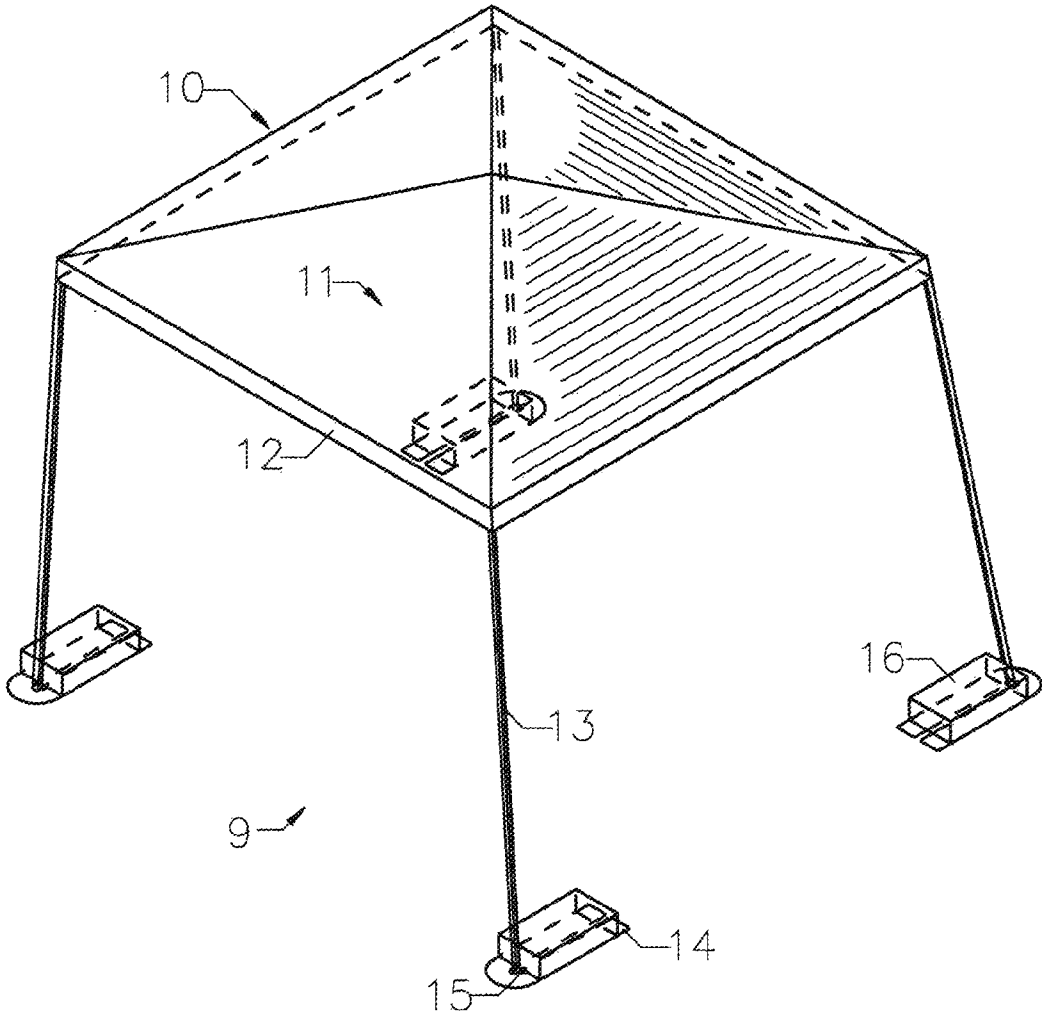
FIG. 1 is shown on sheet numbered 1-9 as a front page perspective view of a portable collapsible canopy unit with four canopy leg hold down plates attached to the canopy frame legs with optional secondary weight on each canopy leg hold down plate.
Figure 2:
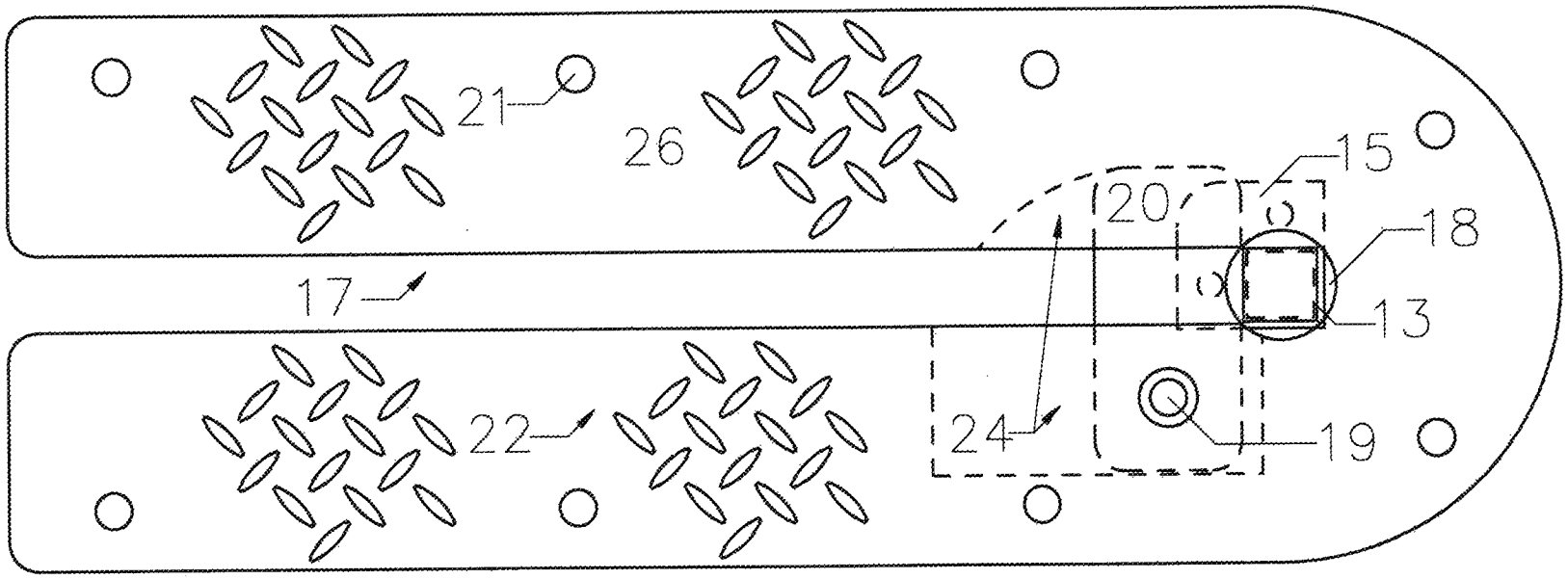
FIGS. 2, 3, 4 and 5 are shown on sheets numbered 2-9, 3-9, 4-9, 5-9 as plan view top, plan view bottom, elevation view and perspective view, respectively, of the canopy leg hold down plate with a recessed locking block swing gate as it fully encloses a portion of the canopy frame leg and covers the majority of the top of the leg's welded attached footplate.
Figure 3:
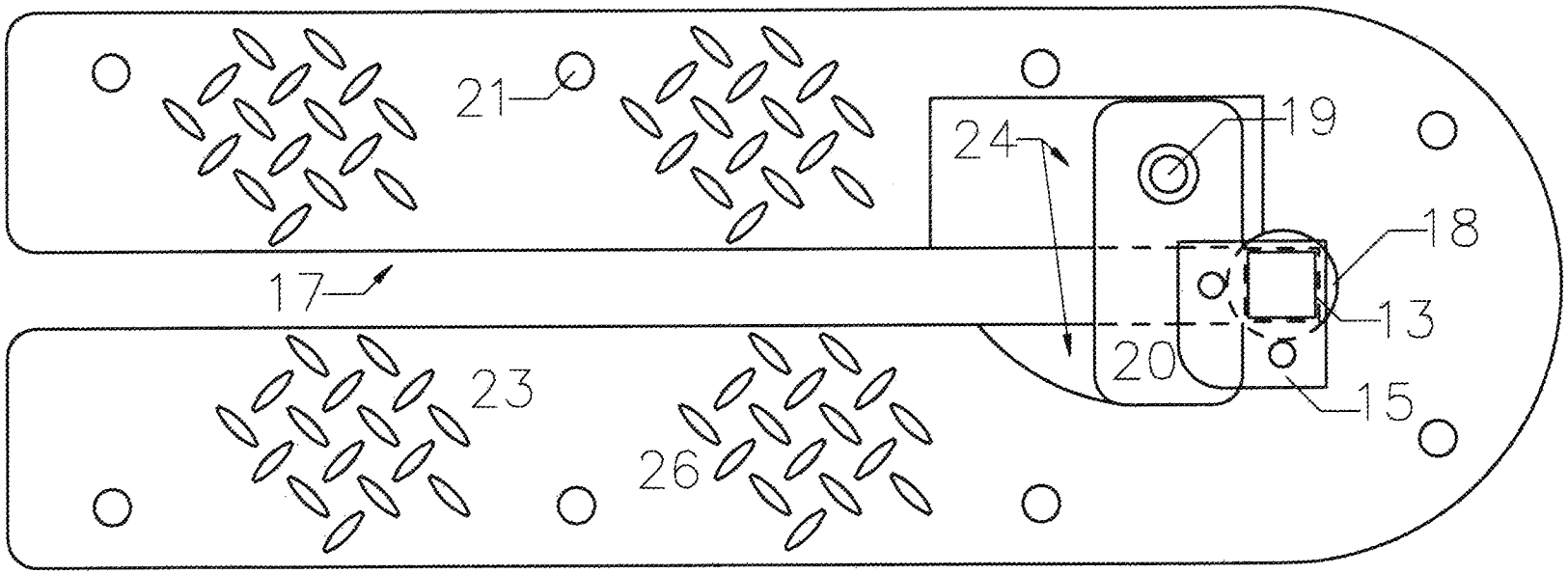
Figure 4:
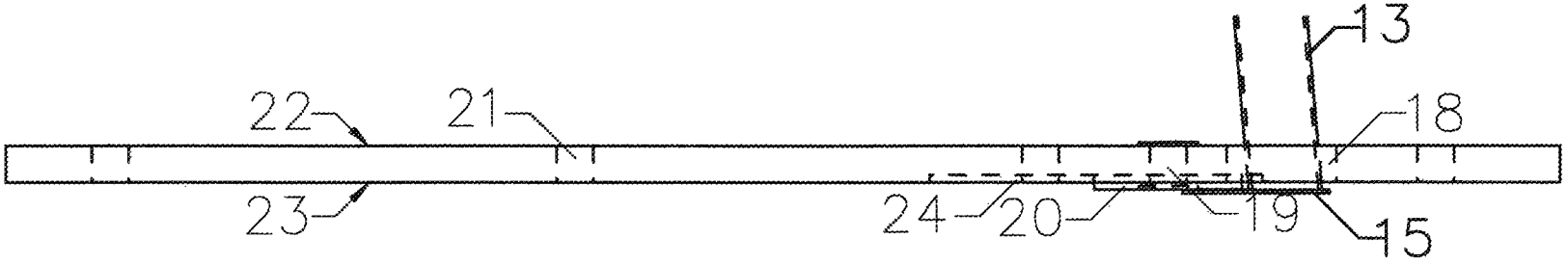
Figure 5:
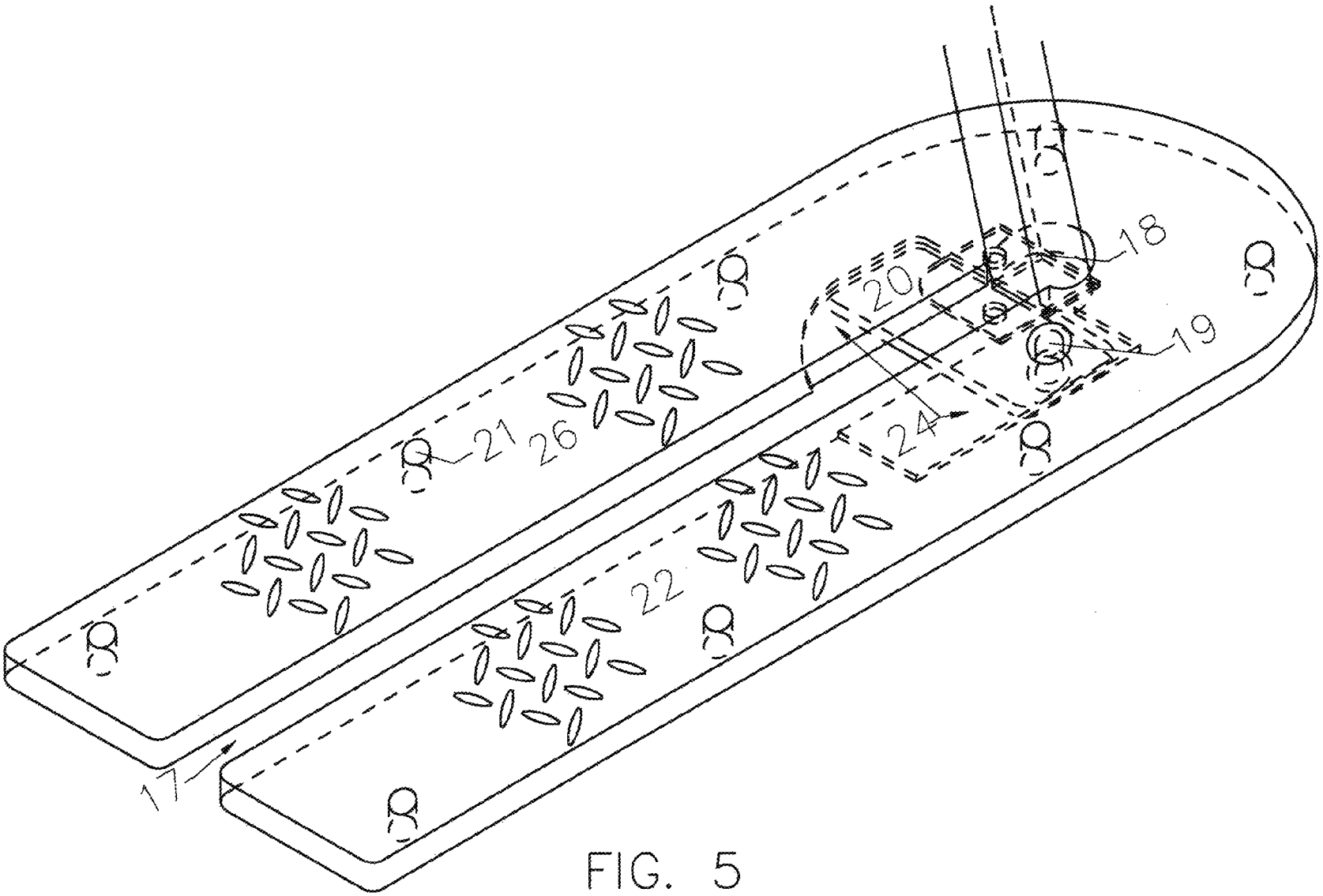
Figure 6:
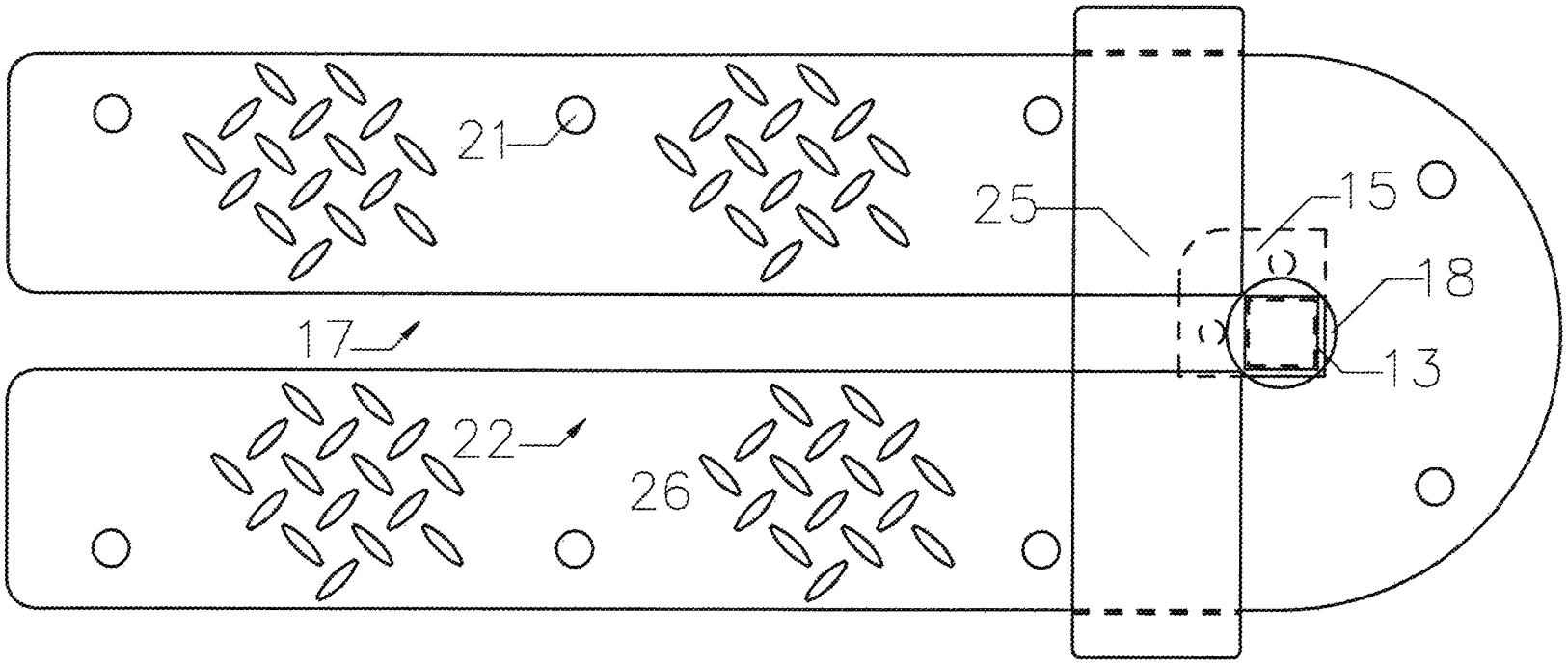
FIGS. 6, 7, 8 and 9 are shown on sheets numbered 6-9, 7-9, 8-9, 9-9 as plan view top, plan view bottom, elevation view and perspective view, respectively, of the canopy leg hold down plate with a locking block slide gate as it fully encloses a portion of the canopy frame leg and covers the majority of the top of the leg's welded attached footplate.
Figure 7:
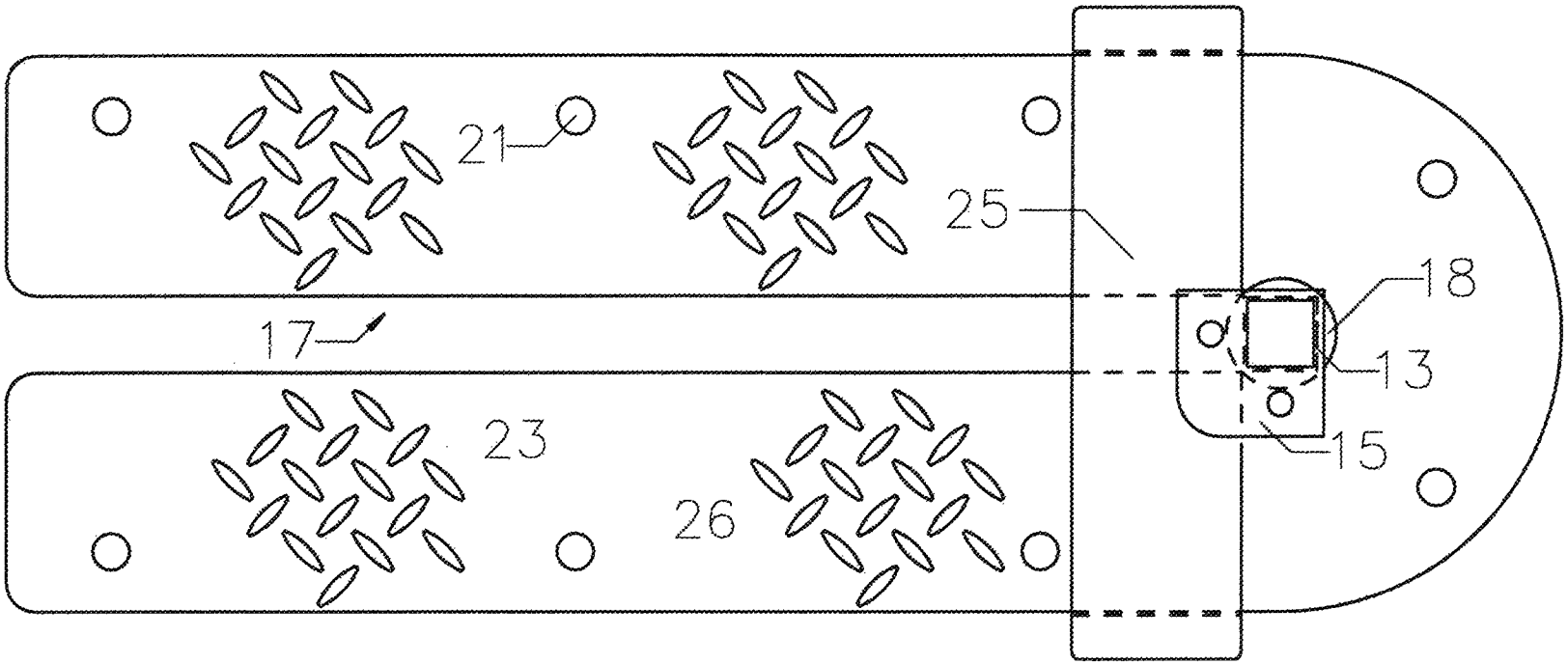
Figure 8:
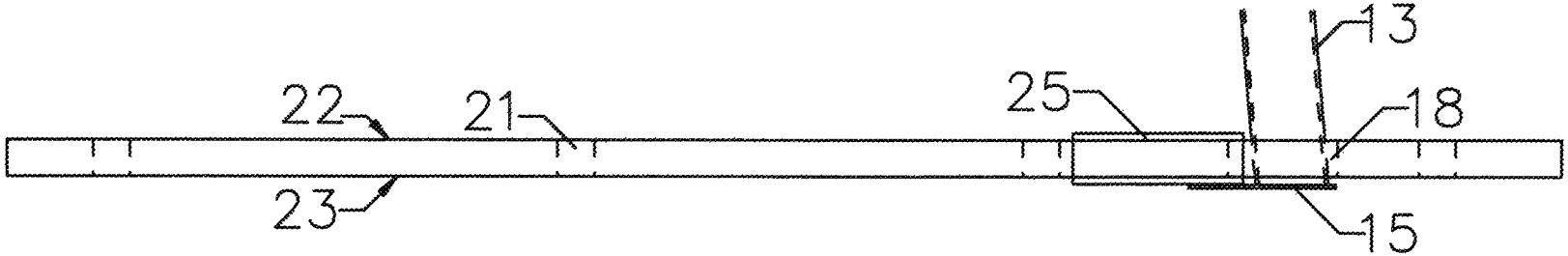
Figure 9:
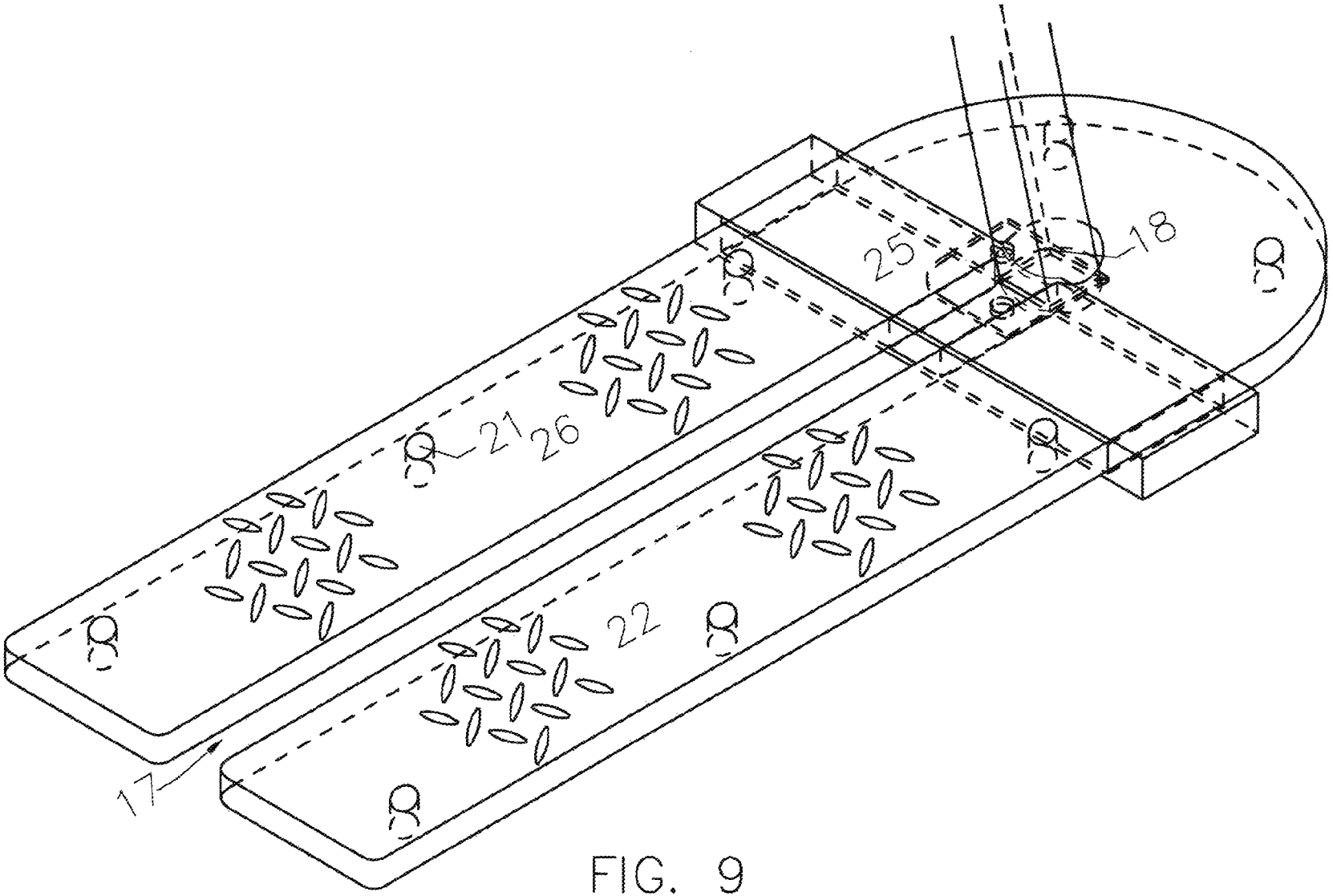

FIG. 1 shows in general a portable collapsible canopy unit 10 that includes a fabric canopy 11 which is supported by a collapsible metal frame 12. The collapsible metal frame 12 has multiple canopy frame legs 13, each with a leg welded attached footplate 15. These canopy units are designed for quick and easy placement and displacement, are lightweight to transport and conveniently stored. Removable and enclosing each canopy frame leg 13 and covering the majority of the top of each welded attached footplate 15 is a canopy leg hold down plate 14, made of pressure molded plastic, preferably recycled plastic, material, measuring about six (6) inches in width, about (20) twenty inches in length and about one-half (½) inch in thickness, which when used with a secondary weight 16 and/or ground pegging anchorage force to the existing pavement or ground 9. Secondary weight 16 may be placed on each canopy leg hold down plate 14.

FIGS. 2, 3, 4 and 5 show in detail canopy leg hold down plate 14 made of pressure molded plastic, preferably recycled plastic, material which comprises a top patterned area 22 and bottom patterned area 23, both areas having a pressure molded plastic diamond tread pattern 26 to reduce lateral movement of the secondary weight 16 and to reduce lateral movement against the existing pavement or ground 9.

The canopy leg hold down plate 14 has a leg insertion channel 17, about fourteen (14) inches in length, to provide for the insertion of a canopy frame leg 13, and a channel terminus hole 18 to partially enclose the canopy frame leg 13 and partially cover the top of the leg's welded attached footplate 15. The canopy leg hold down plate 14 has a locking block swing gate 20 which pivots within a molded recessed area 24 on the bottom patterned area 23. The locking block swing gate 20 is attached by, and pivots on, a plastic or metal rivet 19 attached through the canopy leg hold down plate 14 to allow for open and close positioning within the molded recessed area 24. In the open position, the locking block swing gate 20 is turned parallel to the leg insertion channel 17 within the molded recessed area 24. The locking block swing gate 20 is turned perpendicular to the leg insertion channel 17 to its closed position within the molded recessed area 24. Closed positioning allows the locking block swing gate 20 and the canopy leg hold down plate 14 to completely enclose the canopy frame leg 13 and cover the majority of the top of the leg's welded attached footplate 15.

The canopy leg hold down plate 14 has several bored holes 21 through the top patterned area 22 and bottom patterned area 23 to provide pegging anchorage to the existing ground 9. The top patterned area 22 is of size and shape to accept a plurality of secondary weights 16.

The canopy leg hold down plate may be molded into various decorative shapes different from the shape presented. For attractiveness, uniqueness and occupation recognition, the plate may be molded as a human foot, shoe, animal paw, clawed bird foot or clawed reptilian foot, flower or tree silhouette.

In practice, when the canopy unit 10 is set up, an individual or individuals place one canopy leg hold down plate 14 on each canopy frame leg 13 in accordance with the following procedures. The locking block swing gate 20, pivoting on the plastic or metal rivet 19, is turned parallel to the leg insertion channel 17 within the molded recessed area 24 for open positioning. The canopy leg hold down plate 14 is placed around the canopy frame leg 13 by inserting the said canopy frame leg 13 into the leg insertion channel 17 and then, the canopy leg hold down plate 14 is slid to the channel terminus hole 18. The locking block swing gate 20, pivoting on the plastic or metal rivet 19, is turned perpendicular to the leg insertion channel 17 within the molded recessed area 24 to the closed position. This fully encloses the canopy frame leg 13 and covers the majority of the top of the leg's welded attached footplate 15.

The canopy leg hold down plate 14 is placed upon the existing pavement or ground 9, pivotally about the canopy frame leg 13. Secondary weight 16 may be placed on the top patterned area 22 to provide anchorage force to the bottom patterned area 23, and provide force to keep the locking block swing gate 20 in the closed position within the molded recessed area 24. Ground anchorage may be achieved by pegging through the bored holes 21. A combination of placing secondary weight 16 and pegging through the bored holes 21 may be employed to anchor the canopy unit to the existing ground 9.

FIGS. 6, 7, 8 and 9 show in detail the canopy leg hold down plate 14 made of pressure molded plastic, preferably recycled plastic, material which comprises a top patterned area 22 and bottom patterned area 23, both haying a pressure molded plastic diamond tread pattern 26 to prevent lateral movement of the secondary weight 16 and to prevent lateral movement against the existing pavement or ground 9.

The canopy leg hold down plate 14 has a leg insertion channel 17, about fourteen (14) inches in length, to provide for the insertion of a canopy frame leg 13 and a channel terminus hole 18 to partially enclose the canopy frame leg 13 and partially cover the top of the leg's welded attached footplate 15. The canopy leg hold down plate 14 has a separate locking block slide gate 25. The locking block slide gate 25 engages the leg insertion channel 17 and outer edges of the canopy leg hold down plate 14 and partially slides over the top patterned area 22 and bottom patterned area 23 the length of the leg insertion channel 17 to allow for open and close positioning. Completely sliding the locking block slide gate 25 off of the canopy leg hold down plate 14 allows for open positioning. In the closed position, the locking block slide gate 25 fits into the leg insertion channel 17 and overhangs both outer edges of the canopy leg hold down plate 14 and partially covers the top patterned area 22 and bottom patterned area 23. Sliding the locking block slide gate 25 along the canopy leg hold down plate 14 until it's contiguous to the canopy frame leg 13 within the channel terminus hole 18 closes the locking block slide gate 25, and completely encloses the canopy frame leg 13 and covers the majority of the top of the leg's welded attached footplate 15.

The canopy leg hold down plate 14 has several bored holes 21 through the top patterned area 22 and bottom patterned area 23 to provide for pegging anchorage to the existing ground 9. The top patterned area 22 is of size and shape to accept a plurality of secondary weights 16.

The canopy leg hold down plate may be molded into various decorative shapes different from the shape presented. For attractiveness, uniqueness and occupation recognition, the plate may be molded as a human foot, shoe, animal paw, clawed bird foot or clawed reptilian foot, flower or tree silhouette In practice, when the canopy unit 10 is set up, an individual or individuals, place one canopy leg hold down plate 14 on each canopy frame leg 13 in accordance with the following procedures. The locking block slide gate 25 is slid completely off the canopy leg hold down plate 14 for open positioning. The canopy leg hold down plate 14 is placed around the canopy frame leg 13 inserting the canopy frame leg 13 into the leg insertion channel 17 and then, the canopy leg hold down plate 14 is slid so that the canopy frame leg 13 engages the channel terminus hole 18. The locking block slide gate 25 is aligned with the open end of the leg insertion channel 17 and both outer edges of the canopy leg hold down plate 14 and slid over the top patterned area 22 and bottom patterned area 23 to the channel terminus hole 18 to its closed position. This fully encloses the canopy frame leg 13 and covers the majority of the to of the leg's welded attached footplate 15.

The canopy leg hold down plate 14 is placed upon the existing pavement or ground 9, pivotally about the canopy frame leg 13. Secondary weight 16 may be placed on the top patterned area 22 to provide anchorage force to the bottom patterned area 23, and to provide force to keep the locking block slide gate 25 in its closed position adjacent to the channel terminus hole 18. Ground anchorage may be achieved by pegging through the bored holes 21. Two bored holes 21, when occupied by ground driven pegs, are designed to keep the locking block slide gate the closed position. A combination of placing secondary weight 16 and pegging through the bored holes 21 may be employed to anchor the canopy unit to the existing ground 9.

What is claimed is:

1. A canopy leg hold down device comprising:

a. an approximately rectangular planar plate with a leg insertion channel extending from a periphery of said planar plate and terminating at an enlarged channel terminus hole;

b. a locking block slide gate slideable along and separable from said leg insertion channel, wherein said locking block slide gate has a portion that slides within the leg insertion channel, a top surface that slides over a top surface of said planar plate and a spaced apart bottom surface that slides under a ground contacting bottom surface of said planar plate, wherein the locking block slide gate is slideable along the leg insertion channel to a position such that a canopy frame leg adapted to be positioned within the enlarged channel terminus hole is completely surrounded by portions of the planar plate and portions of the locking block slide gate; and c. a plurality of bored holes extending through said planar plate adapted for receiving ground anchoring pegs.

2. The canopy leg hold down device of claim 1, wherein a portion of a bottom surface of the approximately rectangular planar plate and a portion of the bottom surface of the locking block slide gate are adapted to cover a majority of a top of a canopy frame leg welded attached footplate.

3. The canopy leg hold down device of claim 1, wherein the approximately rectangular planar plate is pivotally maneuverable around the canopy frame leg.

4. A canopy leg hold down device comprising:

a. an approximately rectangular planar plate having a top surface, a ground contacting bottom surface and a leg insertion channel extending through said top surface and said ground contacting bottom surface, extending from a periphery of said planar plate and terminating at an enlarged channel terminus hole;

b. a locking block swing gate pivotally movable within a molded recessed area formed in the ground contacting bottom surface of said planar plate, wherein the locking block swing gate is movable between an open position wherein said locking block swing gate is parallel to the leg insertion channel allowing for insertion of a canopy frame leg into said enlarged channel terminus hole and a closed position wherein said locking block swing gate is perpendicular to said leg insertion channel such that portions of the planar plate and the locking block swing gate are adapted to completely surround the canopy frame leg positioned within the channel terminus hole; and c. a plurality of bored holes extending through said top surface and said ground contacting bottom surface of said planar plate for receiving ground anchoring pegs.

5. The canopy leg hold down device of claim 4, wherein a portion of the ground contacting bottom surface of the approximately rectangular planar plate and a portion of a bottom surface of the locking block swing gate are adapted to cover a majority of a top of a canopy frame leg welded attached footplate.

6. The canopy leg hold down device of claim 4, wherein the approximately rectangular planar plate is pivotally maneuverable around the canopy frame leg.

* * * * *